US005657037A

United States Patent [19]

Okada et al.

[11] Patent Number: 5,657,037

[45] Date of Patent: Aug. 12, 1997

[54] DISPLAY APPARATUS

[75] Inventors: Shinjiro Okada, Isehara; Yutaka Inaba, Kawaguchi; Kazunori Katakura, Atsugi, all of Japan

[73] Assignee: Canon Kabushiki Kaisha, Tokyo, Japan

[21] Appl. No.: 541,625

[22] Filed: Oct. 10, 1995

Related U.S. Application Data

[63] Continuation of Ser. No. 162,697, Dec. 7, 1993, abandoned.

[30] Foreign Application Priority Data

Dec. 21, 1992 [JP] Japan ..... 4-355394

[51] Int. Cl.[6] ..... G09G 3/36

[52] U.S. Cl. ..... 345/94; 345/78; 345/87

[58] Field of Search ..... 345/76, 77, 78, 345/94, 101, 105, 208, 87

[56] References Cited

U.S. PATENT DOCUMENTS

| | | | |
|---|---|---|---|
| 4,367,924 | 1/1983 | Clark et al. . | |
| 4,563,059 | 1/1986 | Clark et al. . | |
| 4,636,789 | 1/1987 | Yamaguchi | 345/208 |
| 4,655,561 | 4/1987 | Kanbe et al. . | |
| 4,815,823 | 3/1989 | Kaneko . | |
| 4,906,072 | 3/1990 | Kaneko | 349/37 |
| 5,093,654 | 3/1992 | Swift | 345/76 |
| 5,124,826 | 6/1992 | Yoshioka et al. . | |
| 5,172,105 | 12/1992 | Katakura et al. . | |
| 5,182,662 | 1/1993 | Mihara . | |
| 5,212,575 | 5/1993 | Kojima et al. . | |

FOREIGN PATENT DOCUMENTS

| | | |
|---|---|---|
| 0345399 | 12/1989 | European Pat. Off. . |
| 0434033 | 6/1991 | European Pat. Off. . |
| 56-107216 | 8/1981 | Japan . |
| 62-239778 | 10/1987 | Japan . |
| 63-148781 | 6/1988 | Japan . |
| 2244024 | 9/1990 | Japan . |
| 4125518 | 4/1992 | Japan . |
| 4218022 | 8/1992 | Japan . |
| 4293014 | 10/1992 | Japan . |

OTHER PUBLICATIONS

Paolo Maltese, "Cross–modulation and disuniformity in the addressing of passive matrix displays". 1984.

Noel A. Clark, et al., "Submicrosecond Bistable Electro–Optic Switching In Liquid Crystals", Applied Physics Letter, vol. 36, No. 11, pp. 899–901, (Jun. 1980).

N.A. Clark, et al, "Ferroelectric Liquid Crystal Electro–Optics Using the Surface Stabilized Structure", Molecular Crystals and Liquid Crystals, vol. 94, Nos. 1 and 2, pp. 213–233 (May 1983).

*Primary Examiner*—Richard Hjerpe
*Assistant Examiner*—Kent Chang
*Attorney, Agent, or Firm*—Fitzpatrick, Cella, Harper & Scinto

[57] ABSTRACT

A display panel is formed of a first electrode plate having thereon a plurality of first elongated electrodes, a second electrode plate having thereon a plurality of second elongated electrodes, and an active substance, such as a liquid crystal, disposed between the first and second electrode plates so as to form a pixel at each intersection of the first and second elongated electrodes. The panel is driven by applying data signals to the first and second elongated electrodes so as to provide a voltage signal applied to the active substance at the pixels while modulating a data signal applied to at least one of the first and second elongated electrodes depending on rounding of a voltage signal applied to the active substance at an associated pixel.

9 Claims, 11 Drawing Sheets

V=0

V < Vth

Vth<V<Vsat

Vsat < V

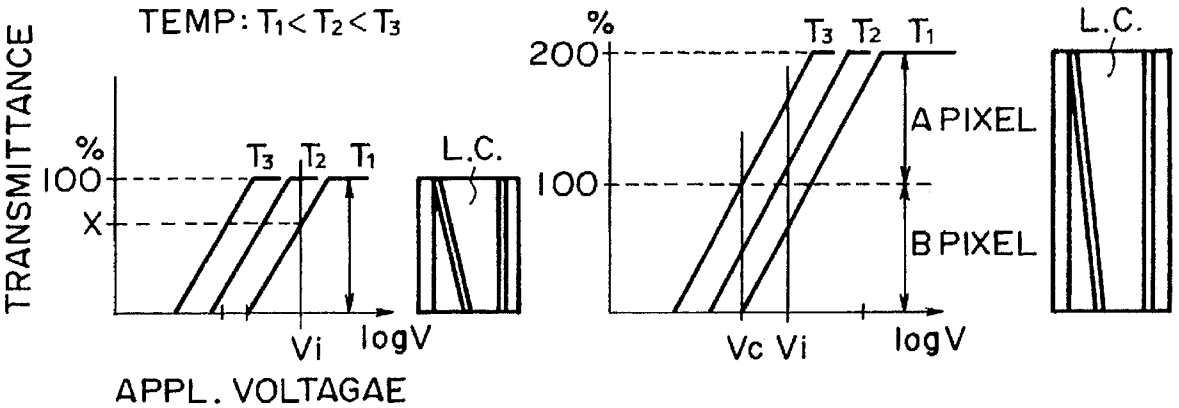
FIG. 13A
FIG. 13B
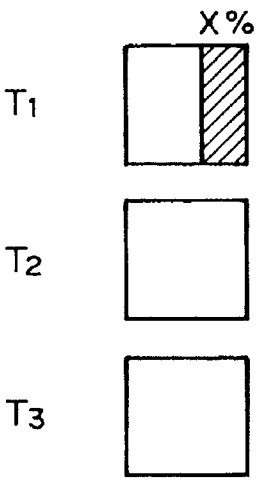
FIG. 13C
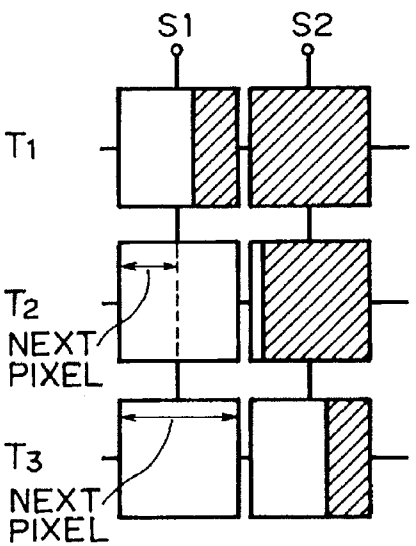
FIG. 13D

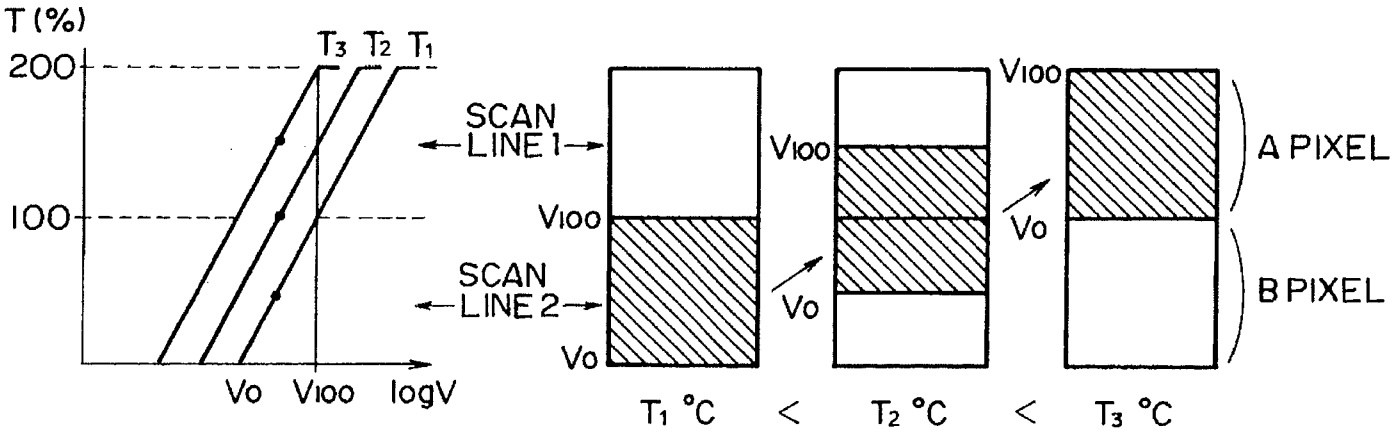
FIG. 14A
FIG. 14B
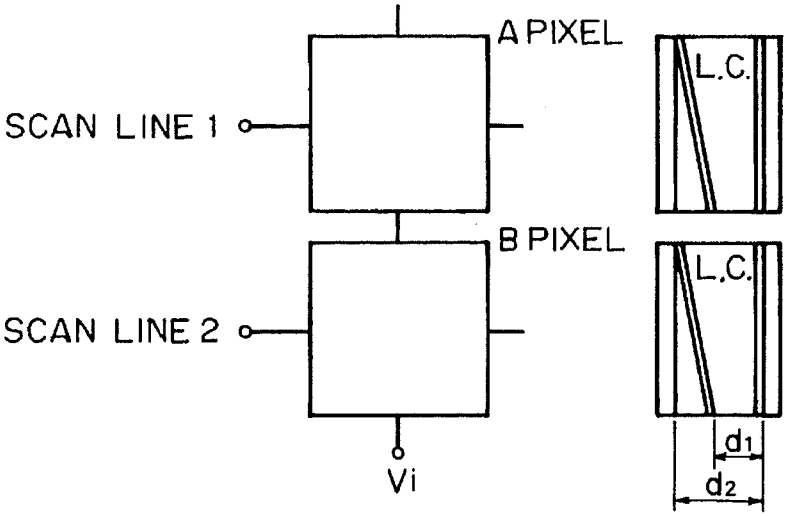
FIG. 15A
FIG. 15B

DISPLAY APPARATUS

This application is a continuation of application Ser. No. 08/162,697, filed Dec. 7, 1993, now abandoned.

FIELD OF THE INVENTION AND RELATED ART

The present invention relates to a display apparatus for computer terminals, television receivers, word processors, typewriters, etc., inclusive of a light valve for projectors, a view finder for video camera recorders, etc.

There have been known electrochromic devices, electroluminescent devices, electron-discharge devices, and liquid crystal display devices including those using twisted-nematic (TN) liquid crystals, guest-host-type liquid crystals, smectic (Sm) liquid crystals, etc.

In a liquid crystal device among these display devices, such a liquid crystal is disposed between a pair of substrates and changes an optical transmittance therethrough depending on voltages applied thereto.

Also, in other types of display devices, an electrochromic substance or an electroluminescent substance is disposed between a pair of electrodes and is supplied with a voltage to effect a display.

A liquid crystal device (cell or panel) is ordinarily constituted by disposing a pair of substrates each having thereon a group of stripe-shaped transparent electrodes so that their stripe electrodes intersect each other and sealing a liquid crystal between the, substrates.

As a result, each unit pixel is formed at an intersection of the stripe electrodes. Accordingly, if the display panel (picture area) is enlarged in size and the pixel size is made smaller, each stripe electrode is caused to have a larger length and a narrower width. As a result, when each stripe electrode is used as a scanning electrode or a data electrode, the delay of a signal inputted thereto can be a problem.

In order to obviate the signal delay, it has been practiced to dispose on a side of a stripe-shaped transparent conductor film a stripe pattern of a metal, such as Cr or Mo, having a lower resistivity (i.e., higher electroconductivity) than the transparent conductor film, thereby providing an electrode structure with a lower resistance. Details of such electrode structures are disclosed in, e.g., U.S. Pat. No. 5,212,575 issued to Kojima et al, U.S. Pat. No. 5,182,662 issued to Mihara, and U.S. Pat. No. 5,124,826 issued to Yoshioka et al.

However, as the liquid crystal device is caused to have a further increased picture area and a higher resolution, the signal delay cannot be sufficiently obviated by the abovementioned improvement in electrode structure.

The use of Au as a material for constituting a low-resistivity metal pattern has also been proposed but has not provided an essential solution in view of the increase in production cost and the decrease in opening rate within the picture area.

These problems are also commonly encountered in electrochromic devices, electroluminescence devices and electron discharge devices also using X-Y matrix elctrodes.

SUMMARY OF THE INVENTION

An object of the present invention is to provide a display apparatus having solved the abovementioned technical problems of the display devices and obviating adverse effects to pixels caused by the signal delay.

Another object of the present invention is to provide a display apparatus capable of effecting good image display without causing an increase in production cost.

According to the present invention, there is provided a display apparatus, including:

a display panel comprising a first electrode plate having thereon a plurality of first elongated electrodes, a second electrode plate having thereon a plurality of second elongated electrodes, and an active substance disposed between the first and second electrode plates so as to form a pixel at each intersection of the first and second elongated electrodes; and drive means including means for applying data signals to the first and second elongated electrodes so as to provide a voltage signal applied to the active substance at the pixels and means for modulating a data signal applied to at least one of the first and second elongated electrodes depending on rounding of a voltage signal applied to the active substance at an associated pixel.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 13A–13D are views for illustrating a pixel shift method.

FIGS. 14A, 14B, 15A and 15B are other views for illustrating a pixel shift method.

DESCRIPTION 0F THE PREFERRED EMBODIMENTS

Hereinbelow, some preferred embodiments of the present invention will be described with reference to the drawings.

Figure 1:
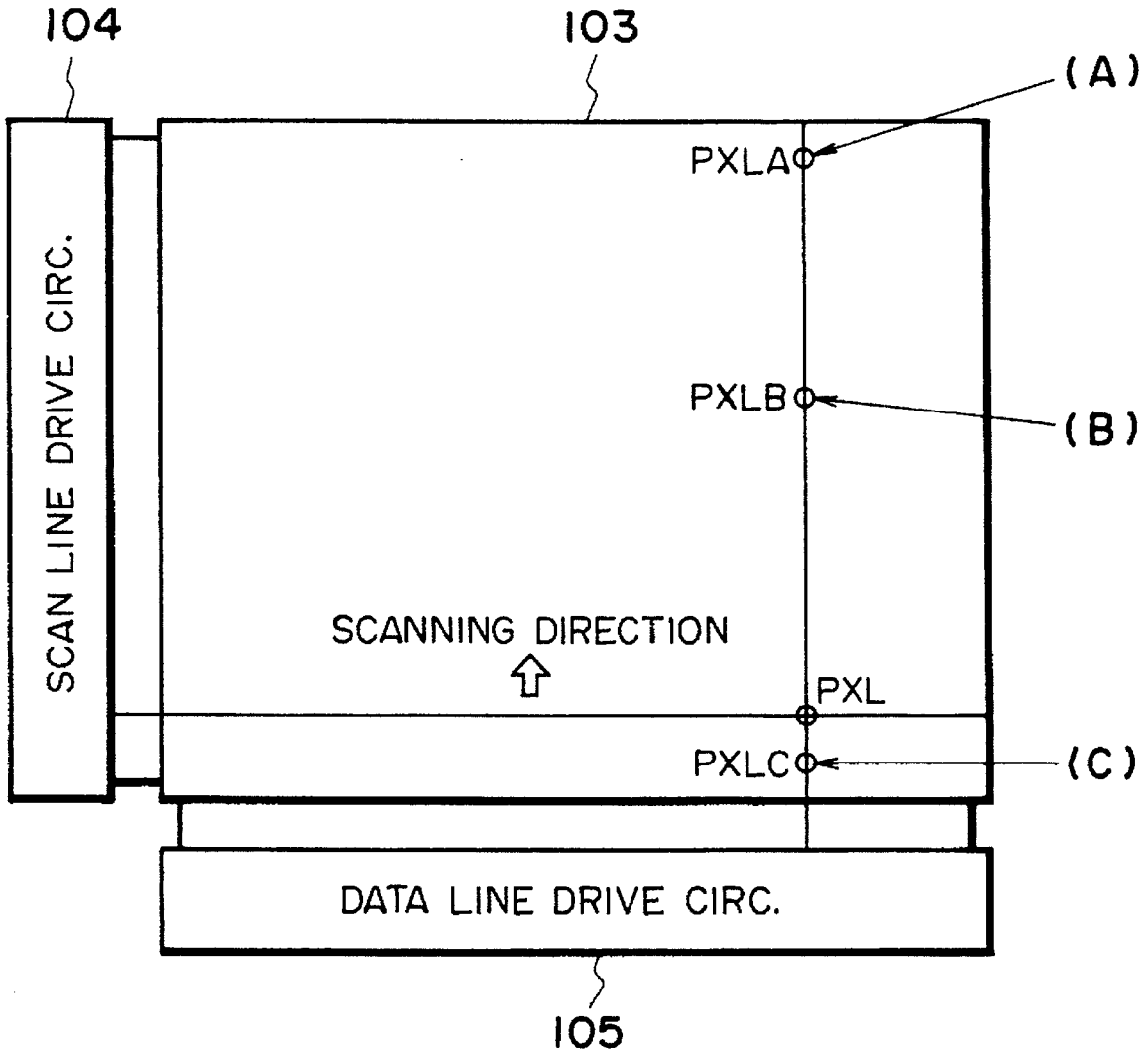
FIG. 1 is a schematic plan view of a display device according to the invention.

FIG. 1 is a schematic block diagram of a display device according to the present invention. Referring to FIG. 1, a display panel 103 comprises a substrate having thereon a plurality of scanning electrodes each constituting a scanning line 14, a substrate having thereon a plurality of data electrodes each constituting a data line 15 and an electrooptically active substance, such as a liquid crystal, disposed between the substrates so as to form pixels (PXLA, PXLB, PXLC) at each intersection of the scanning lines 14 and the data lines 15.

The scanning lines 14 are connected to a scanning line drive circuit 104 for selectively supplying a scanning signal to the scanning lines 14, and the data lines 15 are connected to a data line drive circuit 105 for supplying display data to at least one pixel on a selected scanning line.

In this embodiment, a liquid crystal is used as the electrooptically active substance but it is also possible to use an electrochromic substance or an electroluminescence substance instead thereof.

In this embodiment, a pixel on a data line is supplied with a data signal modulated depending on the position of the pixel.

For example, data signals supplied to pixels PXLA, PXLB and PXLC in FIG. 1 are different from each other in at least one of waveform, peak height and pulse width depending on their different positions on the data line 15.

The modulation of data signals may be effected by appropriately selecting the degree of modulation or modulation scheme depending on the size of the display panel 103, the resistance through a data line and a parasitic capacitance thereto.

The data signals may be set different from pixel to pixel on a data line or so as to provide a common data signal for a group of n adjacent pixels on a data line with the number n being constant or different for a plurality of groups. Each scheme may have its own advantage and disadvantage so that the modulation scheme may be appropriately selected depending on the required characteristic.

Figure 2:
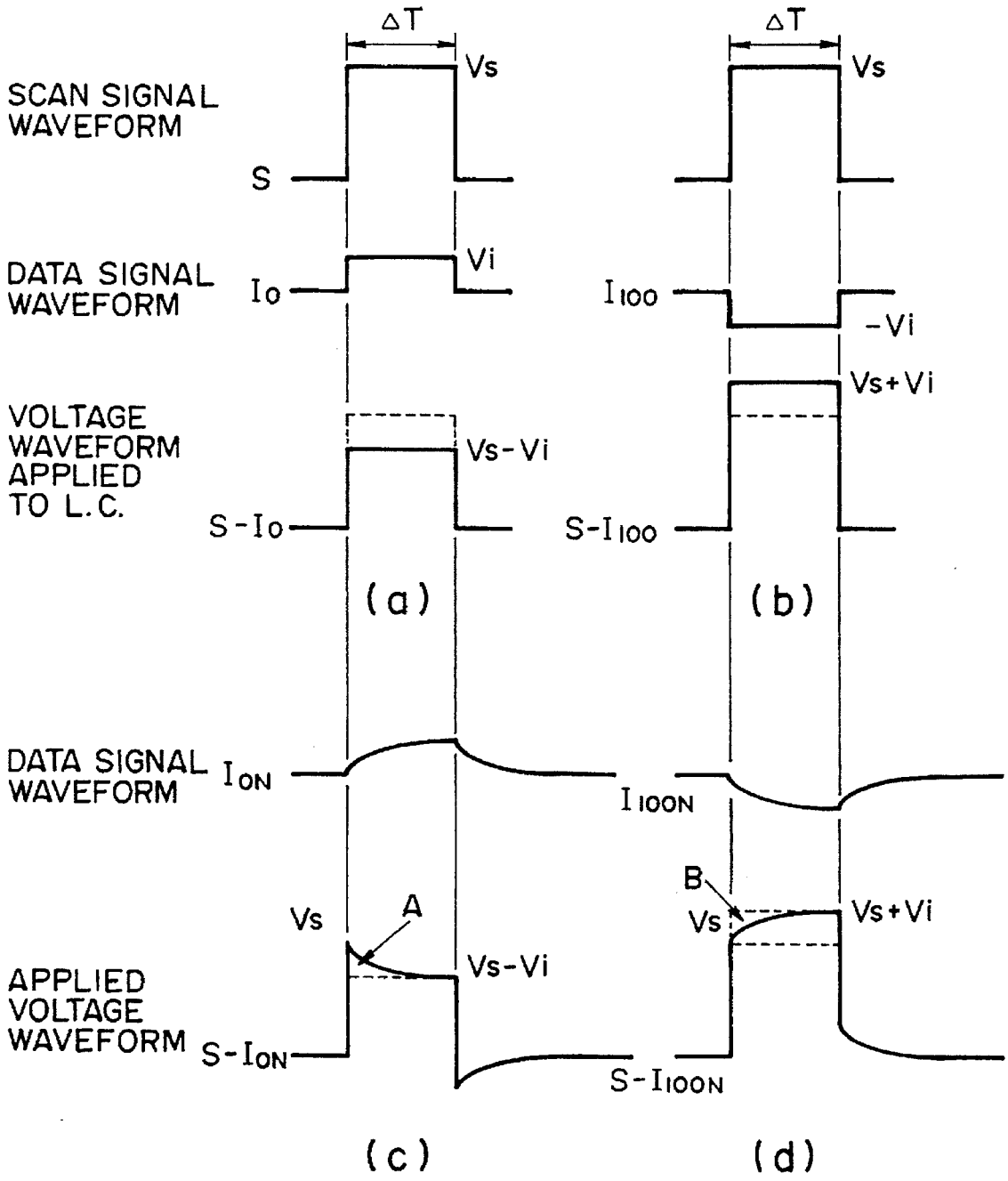
FIG. 2 is a waveform diagram illustrating the deformation (rounding) of waveform.

A modulation scheme according to the present invention will now be described with reference to FIG. 2.

The influence of rounding (deformation) of a data signal voltage waveform on a writing gradation level will be described specifically with reference to FIG. 2. When the voltage waveforms are free from rounding, voltage waveforms applied to a layer of a liquid crystal as an active substance are given by a difference between a scanning signal Vs and a data signal Vi, so that a signal is with a voltage waveform having a peak height Vs−Vi and a pulse width ΔT as shown in FIG. 2(*a*), and another pixel is supplied with a waveform having a peak height Vs+Vi and a pulse width ΔT as shown at FIG. 2(*b*). In contrast thereto, in the case where a data signal waveform is rounded, the effect of the rounding appears in a direction of increasing the voltage applied to a pixel as a difference (providing an increment A at (c)) when the data signal and the scanning signal are of the same polarity and in a direction of decreasing the voltage applied to a pixel (providing a reduction B at (d)) when the data signal and the scanning signal are of opposite polarities.

As is apparent from comparison between $I_0$ and $I_{0N}$ or between $I_{100}$ and $I_{100N}$, this means in a liquid crystal display state that an identical data signal can cause a larger degree of switching at a pixel as shown at (c) than a pixel at (a), and a smaller degree of switching at a pixel as shown at (d) than a pixel at (b) as an influence of the rounding.

However, a liquid crystal panel is preliminarily designed to have a prescribed size, a prescribed layer thickness of a liquid crystal (as an active substance) and prescribed locations of input terminals as shown in FIG. 1, so that it is possible to know that a certain pixel at a certain position is subject to a certain degree of signal waveform transmission delay.

Accordingly, in case where an identical display state is written in pixels at positions (A), (B) and (C) in FIG. 1, the adverse effect of rounding of a data signal can be removed by modulating the data signal so as to compensate for the rounding of the data signal waveform.

Figure 3:
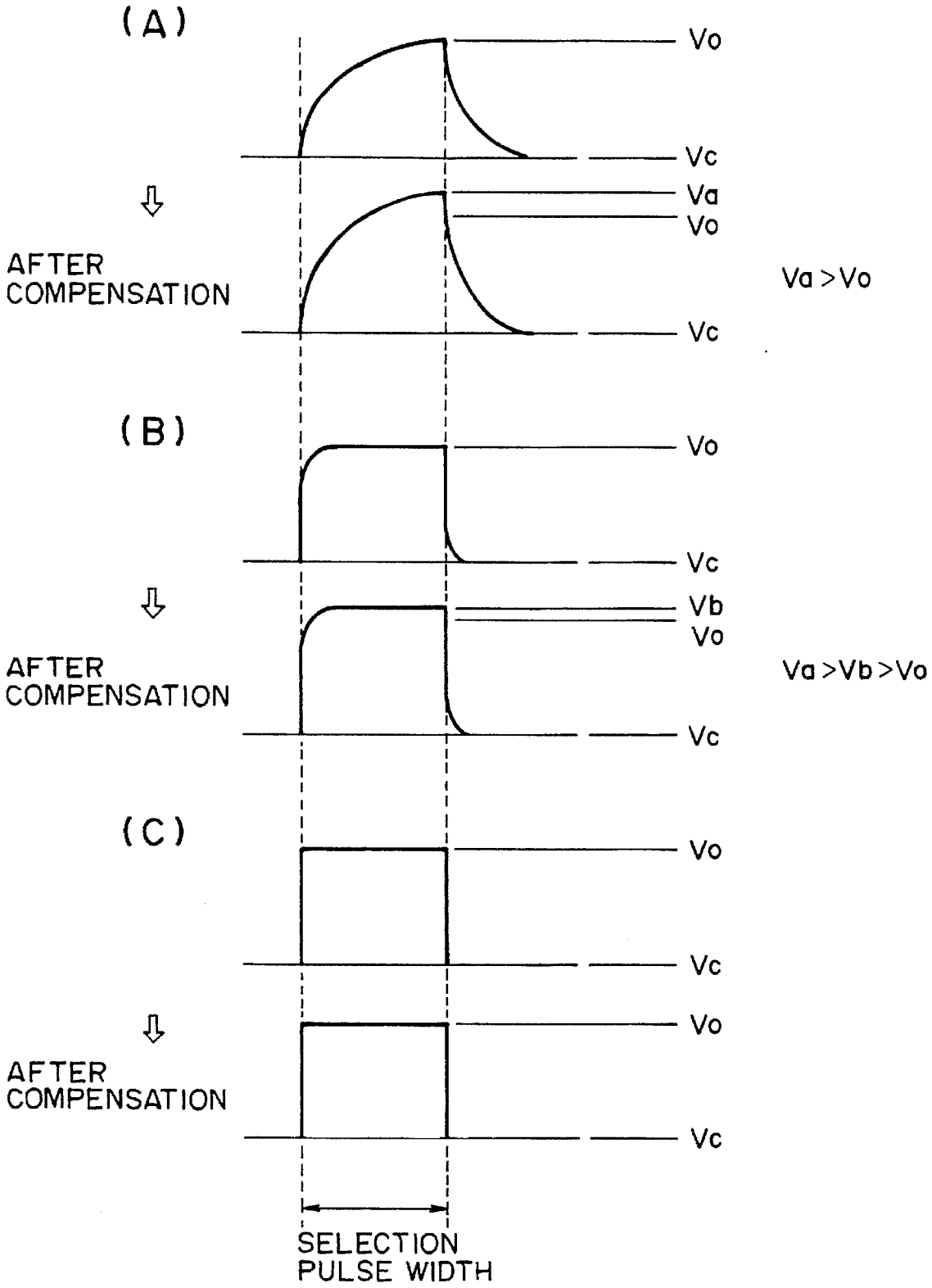
FIG. 3 is a waveform diagram for illustrating the rounding compensation according to the invention.

FIG. 3 shows data signal waveforms before and after such compensation or modulation to be applied at positions (A), (B) and (C), respectively. The compensation may be effected in such a manner that a higher peak value signal is applied to a position susceptible of a larger degree of rounding or deformation. In FIG. 3, peak voltages Va, Vb and Vc are set so as to satisfy Va>Vb>Vc conforming to the order of degree of rounding. In the case of FIG. 3, the effect of rounding is corrected by changing peak values of input data signals, but the correction can also be effected by changing the pulse width.

As described above, it is possible to suppress the variation of gradation level caused by the influence of rounding of a signal form by feeding the degree of the rounding back to a data signal generation unit.

Figure 4:
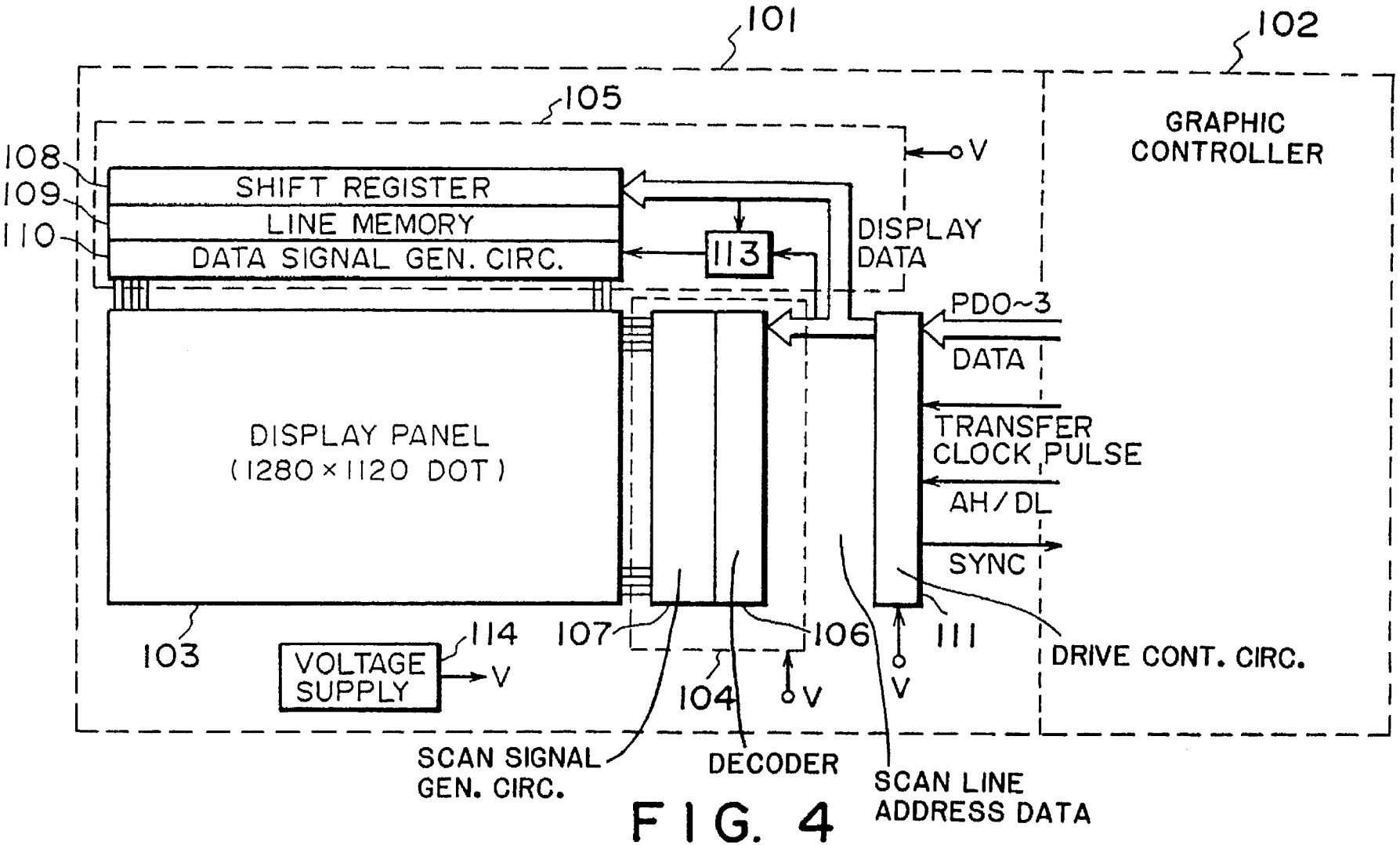
FIG. 4 is a control system block diagram for a display apparatus according to the invention.
Figure 5:
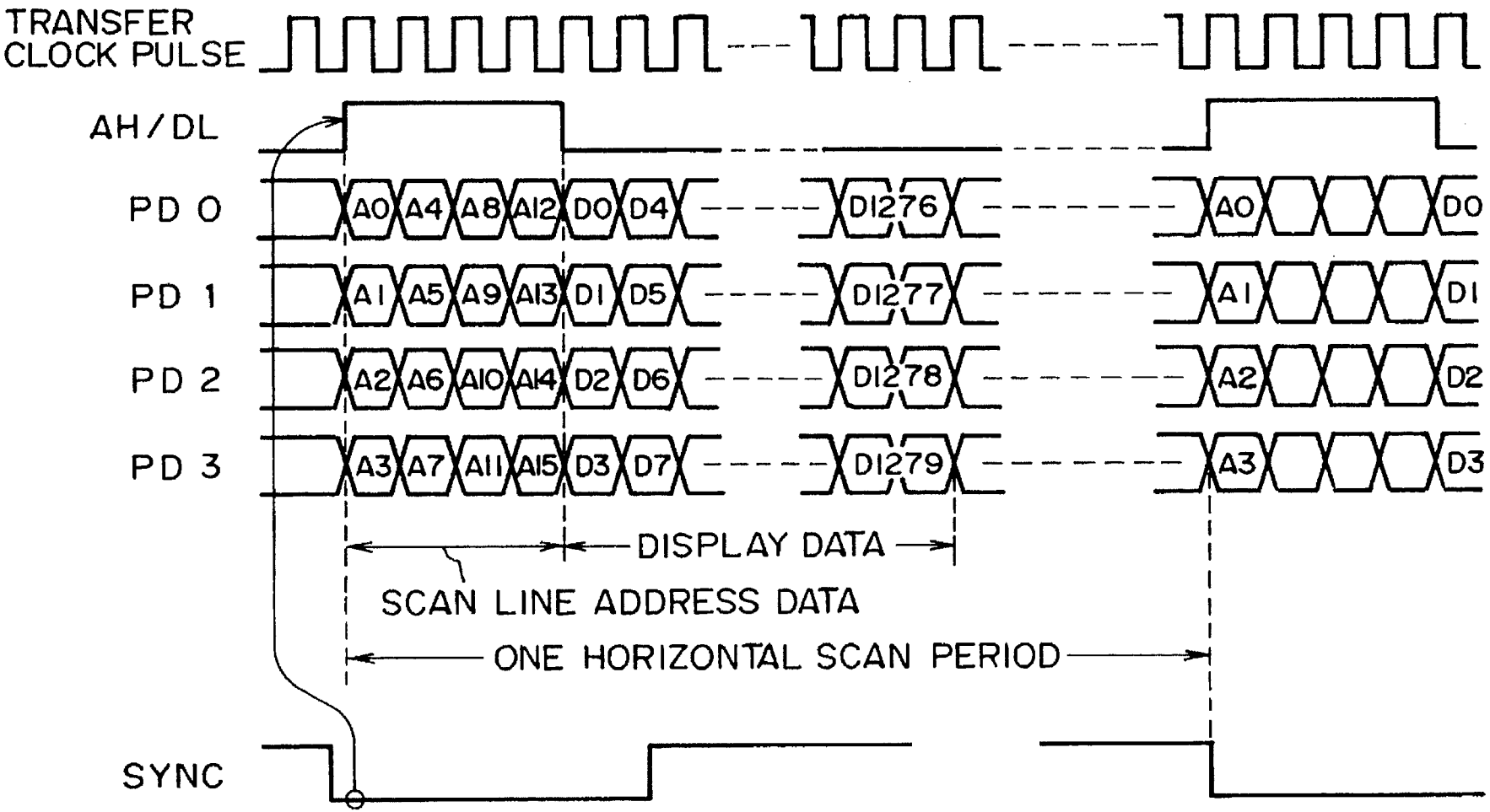
FIG. 5 is a time chart for the display apparatus shown in FIG. 4.

Now, a basic method of driving a liquid crystal display device according to the present invention will be described. FIG. 4 is a block diagram of a control system for a display apparatus according to the present invention, and FIG. 5 is a time chart for communication of image data therefor.

A graphic controller 102 supplies scanning line address data for designating a scanning electrode and image data PD0–PD3 for pixels on the scanning line designated by the address data to a display drive circuit constituted by a scanning line drive circuit 104 and a data line drive circuit 105 of a liquid crystal display apparatus 101. In this embodiment, scanning line address data (A0–A15) and display data (D0–D1279) must be differentiated. A signal AH/DL is used for the differentiation. The AH/DL signal at a high (Hi) level represents scanning line address data, and the AH/DL signal at a low (Lo) level represents display data.

The scanning line address data is outputted to the scanning line drive circuit 104 from a drive control circuit 111 in the liquid crystal display apparatus 101 based on the image data PD0–PD3. The scanning line address data is inputted to a decoder 106 within the scanning line drive circuit 104, and a designated scanning electrode within a display panel is driven by a scanning signal generation circuit 107 via the decoder 106. On the other hand, display data is introduced to a shift register 108 within the data line drive circuit 105 and shifted by four pixels as a unit based on a transfer clock pulse. When the shifting for 1280 pixels on a horizontal one scanning line is completed by the shift register 108, display data for the 1280 pixels are transferred to a line memory 109 disposed in parallel, memorized therein for a period of one horizontal scanning period and outputted to the respective data electrodes from a data signal generation circuit 110.

Further, in this embodiment, the drive of the display panel 103 in the liquid crystal display apparatus 101 and the generation of the scanning line address data and display data in the graphic controller 102 are performed in a non-synchronous manner, so that it is necessary to synchronize the graphic controller 102 and the display apparatus 101 at the time of image data transfer. The synchronization is performed by a signal SYNC which is generated for each one horizontal scanning period by the drive control circuit ill within the liquid crystal display apparatus 101. The graphic controller 102 always watches the SYNC signal, so that image data is transferred when the SYNC signal is at a low level and image data transfer is not performed after transfer of image data for one scanning line at a high level. More specifically, referring to FIG. 4, when a low level of the SYNC signal is detected by the graphic controller 102, the AH/DL signal is immediately turned to a high level to start the transfer of image data for one horizontal scanning line. Then, the SYNC signal is turned to a high level by the drive control circuit 111 in the liquid crystal display apparatus 101. After completion of writing in the display panel 103 with a lapse of one horizontal scanning period, the drive control circuit 111 again returns the SYNC signal to a low level so as to receive image data for a subsequent scanning line. During the drive, drive voltages and signal voltages are supplied from a voltage supply 114 to the circuits 104, 105 and 111, and drive signals are modulated by a modulation circuit 113.

The drive signal modulation (compensation for round waveform) according to the present invention may be performed by the modulation circuit.

Figure 6:
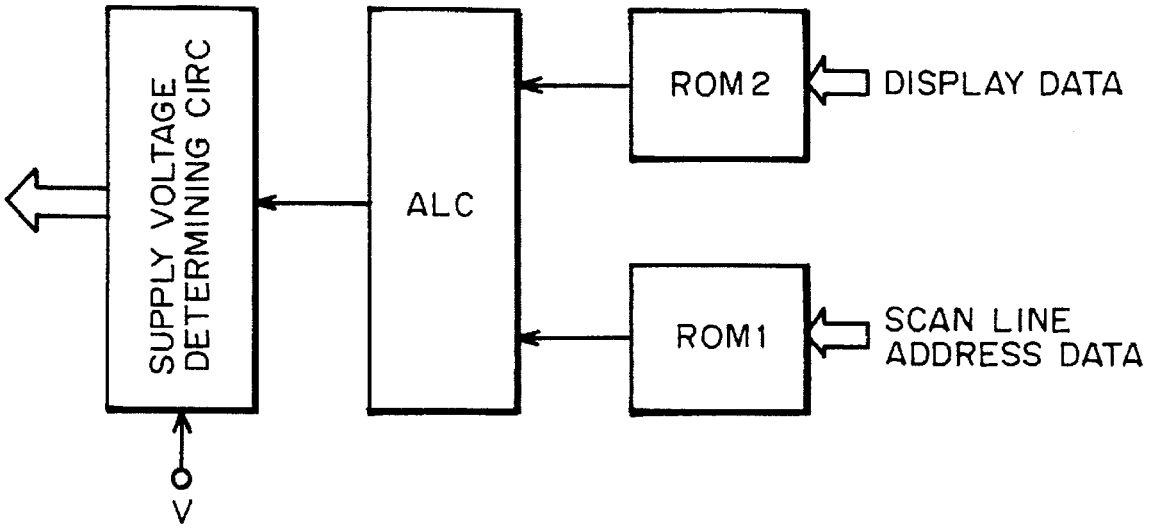
FIG. 6 is a block diagram of a deformation compensation circuit used in the invention.

FIG. 6 is a block diagram of an embodiment of the modulation circuit 113 used in the present invention. The scanning line address data and display data outputted from the drive control circuit 111 (FIG. 4) are inputted to memory devices ROM1 and ROM2, respectively, separately from the decoder 106 and the shift register 108.

ROM1 is a memory circuit for memorizing data based on levels of delay caused by a data line (delay data $\tau$) in internal memory cells. When scanning line address data is inputted to ROM1, delay data $\tau$ corresponding to a scanning line to be addressed is read out from a memory cell and is outputted to a subsequent arithmetic (and logic) unit ALC.

ROM2 is a memory circuit disposed, as desired, when the delay level is affected by other parameters such as temperature, for memorizing correction data therefor.

The arithmetic unit ALC is a circuit for deriving modulation data for data signals by calculation based on data from ROM1 and ROM2.

The modulation data from ALC is inputted to a voltage determining circuit for determining a reference drive voltage after modulation supplied to the data signal generation circuit 110. More specifically, in the case of voltage (peak value) modulation, voltages such as Va and Vb shown in FIG. 3 are supplied based on a supplied voltage V from the voltage supply 114. In the case of pulse width modulation, the supply voltage-determining circuit is replaced by a pulse width-determining circuit to determine the pulse width of data signals by controlling the timing of opening and closing data signal supply gates in the data signal generation circuit 110.

In this embodiment, the voltage from the voltage supply 114 is directly modulated. Instead thereof, it is also possible to feed back modulated data to the voltage supply to have the power supply 114 generate a modulated supply voltage. The supply voltage V may be a voltage signal of a single level or multiple levels.

More specifically, in the case of a display apparatus having an XY-matrix electrode structure as shown in FIG. 1, a pixel PXLB disposed farther from an input terminal of a data line 15 is subject to a larger degree of rounding than a pixel PXLC, and a still farther pixel PXLA is subject to a still larger degree of rounding. Accordingly, the correction value $\Delta V_0$ for a reference peak value $V_0$ of data signals is changed for each scanning line (more exactly a pixel on the scanning line) depending on the location of the scanning line. Thus, $\Delta V_0$ is set smaller for a scanning line close to the input terminal and larger for a scanning line farther from the input terminal.

This is effected by having ROM1 in FIG. 6 memorize parameters corresponding to respective scanning lines and $\Delta V_0$ is calculated by the arithmetic unit ALC based on the parameters for the respective scanning lines. Based on the obtained $\Delta V_0$, a data signal voltage $V_0+\Delta V_0$ is generated by the supply voltage-determining circuit.

By using data signals compensated for the levels of rounding, it is possible to suppress the fluctuation of display state depending on the location of pixels.

In this embodiment, $\Delta V_0$ is determined for each of, e.g., 200 scanning lines but, as described above, it is also possible to determine one $\Delta V_0$ for each of 10 blocks each including 20 lines. Alternatively, the block division may preferably be performed in such a manner that a block close to the input terminal includes, e.g., 20 scanning lines and farther blocks include decreasing number of scanning lines, such as 18, 16, 14 . . . , 2 and 1, as they leave from the input terminal. In this case, the control scheme explained with reference to FIG. 6 may also be applied by storing correction parameters for blocks including the respective scanning lines.

The present invention may of course be applicable to a display apparatus for a binary display of bright and dark but may be particularly effectively applied to a multi-level display, especially a gradational display. Further, the present invention can be applicable to a display panel using a nematic liquid crystal having no dependence on the polarity of an applied voltage but may be effectively applied to a display panel using an electrochromic substance or a smectic liquid crystal capable of controlling a bright or dark state depending on the polarity of an applied voltage.

Hereinbelow, an embodiment of application to a display panel using a smectic liquid crystal for a gradational display will be described.

Clark and Lagerwall have disclosed a bistable ferroelectric liquid crystal device using a surface-stabilized ferroelectric liquid crystal in, e.g., Applied Physics Letters, Vol. 36, No. 11 (Jun. 1, 1980), p.p. 899–901; Japanese Laid-Open Patent Application (JP-A) 56-107216, U.S. Pat. Nos. 4,367,924 and 4,563,059. Such a bistable ferroelectric liquid crystal device has been realized by disposing a liquid crystal between a pair of substrates disposed with a spacing small enough to suppress the formation of a helical structure inherent to liquid crystal molecules in chiral smectic C phase (SmC*) or H phase (SmH*) of bulk state and align vertical (smectic) molecular layers each comprising a plurality of liquid crystal molecules in one direction.

Further, as a display device using such a ferroelectric liquid crystal (FLC), there is known one wherein a pair of transparent substrates respectively having thereon a transparent electrode and subjected to an aligning treatment are disposed to be opposite to each other with a cell gap of about 1–3 μm therebetween so that their transparent electrodes are disposed on the inner sides to form a blank cell, which is then filled with a ferroelectric liquid crystal.

The above-type of liquid crystal display device using a ferroelectric liquid crystal has two advantages. One is that a ferroelectric liquid crystal has a spontaneous polarization so that a coupling force between the spontaneous polarization and an external electric field can be utilized for switching. Another is that the long axis direction of a ferroelectric liquid crystal molecule corresponds to the direction of the spontaneous polarization in a one-to-one relationship so that the switching is effected by the polarity of the external electric field. More specifically, the ferroelectric liquid crystal in its chiral smectic phase show bistability, i.e., a property of assuming either One of a first and a second optically stable state depending on the polarity of an applied voltage and maintaining the resultant state in the absence of an electric field. Further, the ferroelectric liquid crystal shows a quick response to a change in applied electric field. Accordingly, the device is expected to be widely used in the field of e.g., a high-speed and memory-type display apparatus.

A ferroelectric liquid crystal generally comprises a chiral smectic liquid crystal (SmC* or SmH*), of which molecular long axes form helixes in the bulk state of the liquid crystal. If the chiral smectic liquid crystal is disposed within a cell having a small gap of about 1–3 μm as described above, the helixes of liquid crystal molecular long axes are unwound (N. A. Clark, et al., MCLC (1983), Vol. 94, p.p. 213–234).

A liquid crystal display apparatus having a display panel constituted by such a ferroelectric liquid crystal device may be driven by a multiplexing drive scheme as described in U.S. Pat. No. 4,655,561, issued to Kanbe et al to form a picture with a large capecity of pixels. The liquid crystal display apparatus may be utilized for constituting a display panel suitable for, e.g., a word processor, a personal computer, a micro-printer, and a television set.

A ferroelectric liquid crystal has been principally used in a binary (bright-dark) display device in which two stable states of the liquid crystal are used as a light-transmitting state and a light-interrupting state but can be used to effect a multi-value display, i.e., a halftone display. In a halftone display method, the areal ratio between bistable states (light transmitting state and light-interrupting state) within a pixel is controlled to realize an intermediate light-transmitting state. The gradational display method of this type (hereinafter referred to as an "areal modulation" method) will now be described in detail.

Figure 7A:
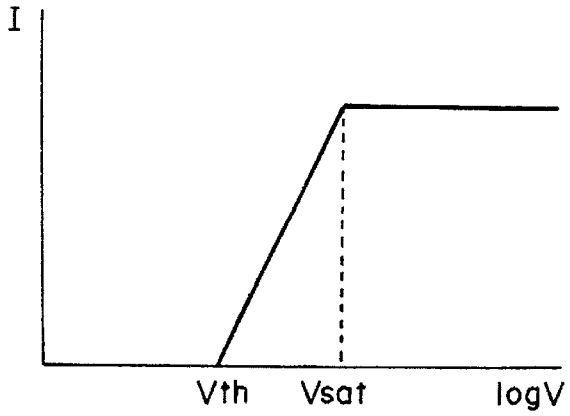
FIGS. 7A and 7B are graphs illustrating a relationship between switching pulse voltage and a transmitted light quantity.
Figure 7B:
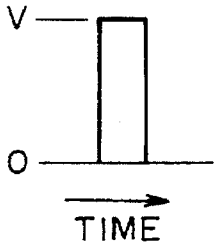
Figure 8A:
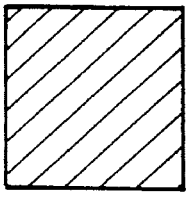
FIGS. 8A–8D illustrate pixels showing various transmittance levels depending on applied pulse voltages.
Figure 8B:
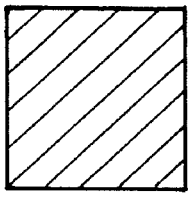
Figure 8C:
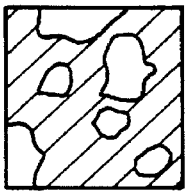
Figure 8D:
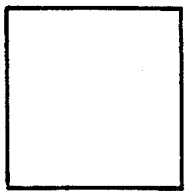

FIG. 7 is a graph schematically representing a relationship between a transmitted light quantity I through a ferroelectric liquid crystal cell and a switching pulse voltage V. More. specifically, FIG. 7A shows plots of transmitted light quantities I given by a pixel versus voltages V when the pixel initially placed in a complete light-interrupting (dark) state is supplied with single pulses of various voltages V and one polarity as shown in FIG. 7B. When a pulse voltage V is below threshold Vth (V<Vth), the transmitted light quantity does not change and the pixel state is as shown in FIG. 8B which is not different from the state shown in FIG. 8A before the application of the pulse voltage. If the pulse voltage V exceeds the threshold Vth (Vth<V<Vsat), a portion of the pixel is switched to the other stable state, thus being transitioned to a pixel state as shown in FIG. 8C showing an intermediate transmitted light quantity as a whole. If the pulse Voltage V is further increased to exceed a saturation value Vsat (Vsat<V), the entire pixel is switched to a light-transmitting state as shown in FIG. 8D so that the transmitted light quantity reaches a constant value (i.e., is saturated). That is, according to the areal modulation method, the pulse voltage V applied to a pixel is controlled within a range of Vth<V<Vsat to display a halftone corresponding to the pulse voltage.

However, actually, the voltage (V)—transmitted light quantity (I) relationship shown in FIG. 7 depends on the cell thickness and temperature. Accordingly, if a display panel is accompanied with an unintended cell thickness distribution or a temperature distribution, the display panel can display different gradation levels in response to a pulse voltage having a constant voltage.

Figure 9:
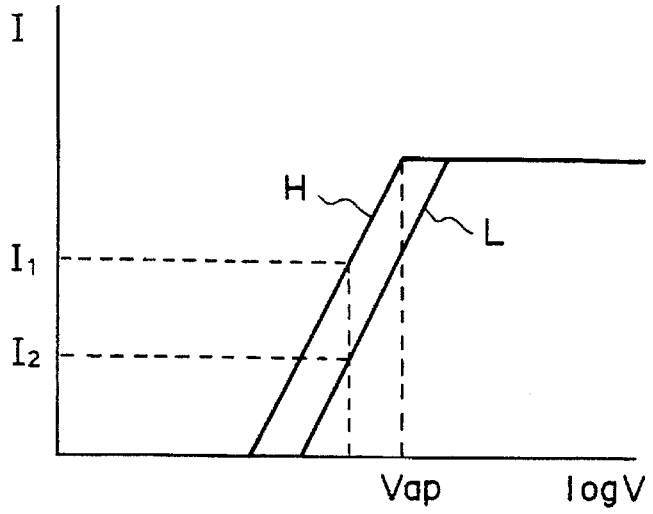
FIG. 9 is a graph for describing a deviation in threshold characteristic due to a temperature distribution.

FIG. 9 is a graph for illustrating the above phenomenon which is a graph showing a relationship between pulse voltage (V) and transmitted light quantity (I) similar to that shown in FIG. 7 but showing two curves including a curve H representing a relationship at a high temperature and a curve L at a low temperature. In a display panel having a large display size, it is rather common that the panel is accompanied with a temperature distribution. In such a case, however, even if a certain halftone level is intended to be displayed by application of a certain drive voltage Vap, the resultant halftone levels can be fluctuated within the range of $I_1$ to $I_2$ as shown in FIG. 9 within the same panel, thus failing to provide a uniform gradational display state.

Figure 10:
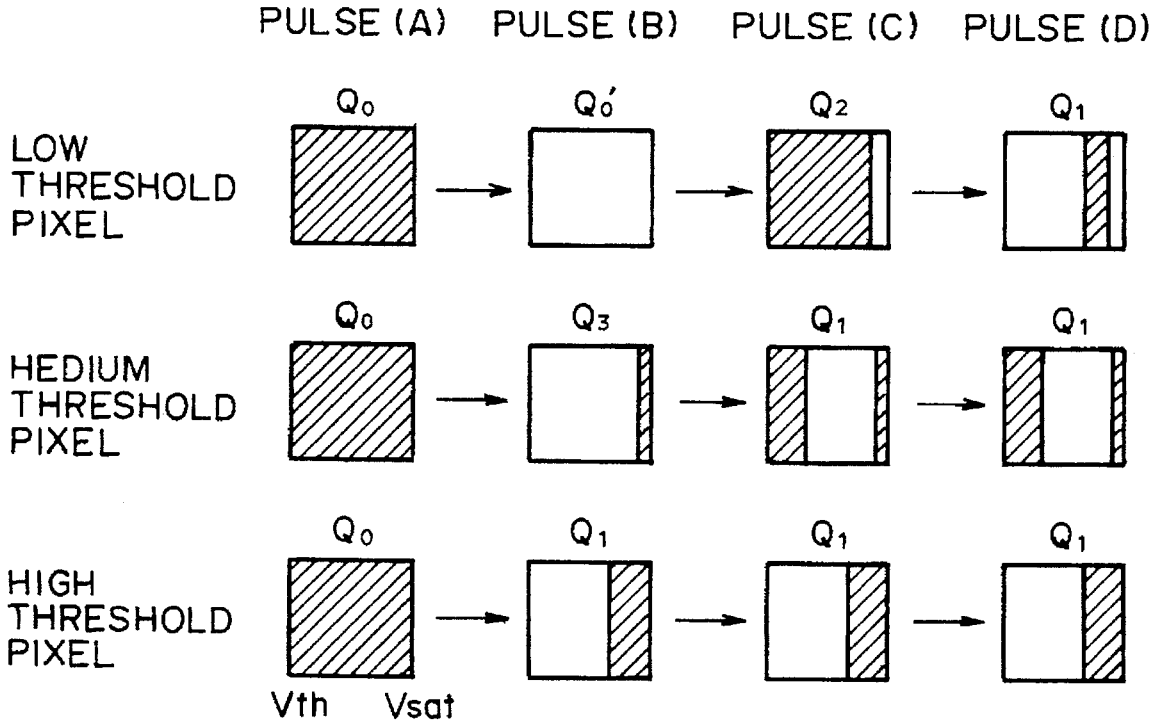
FIG. 10 is an illustration of pixels showing various transmittance levels.
Figure 11:
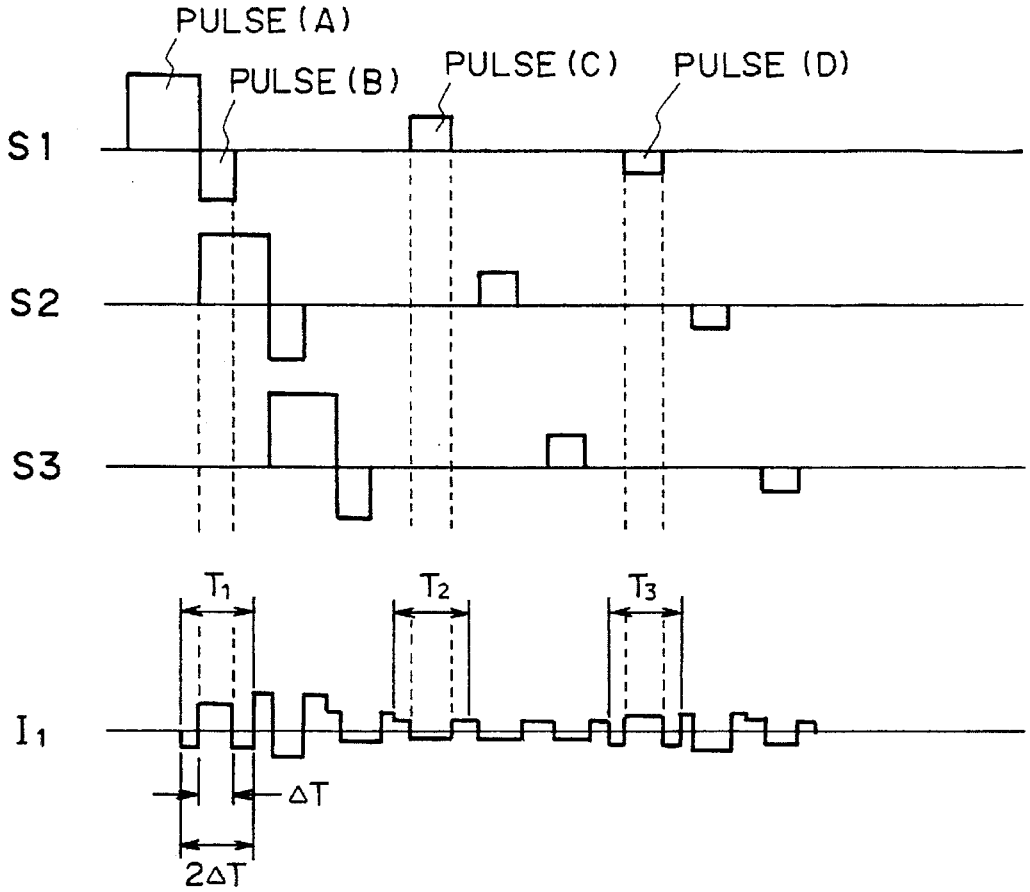
FIG. 11 is a time chart for describing a four-pulse method.

In order to solve the above-mentioned problem, our research group has already proposed a drive method (hereinafter referred to as the four pulse method") in JP-A 4-218022. In the four pulse method, as illustrated in FIGS. 10 and 11, all pixels having mutually different thresholds on a common scanning line in a panel are supplied with plural pulses (corresponding to pulses (A)–(D) in FIG. 10) to show consequently identical transmitted quantities as shown at FIG. 10(D). In FIG. 10, $T_1$, $T_2$ and $T_3$ denote selection periods set in synchronism with the pulses (B), (C) and (D), respectively. Further, $Q_0$, $Q_0'$, $Q_1$, $Q_2$ and $Q_3$ in FIG. 11 represent gradation levels of a pixel, inclusive of $Q_0$ representing black (0%) and $Q_0'$ representing white (100%). Each pixel in FIG. 11 is provided with a threshold distribution within the pixel increasing from the leftside toward the right side as represented by a cell thickness increase.

Our research group has also proposed a drive method (a so-called "pixel shift method", as disclosed in U.S. patent application Ser. No. 984,694, filed Dec. 2, 1992 and entitled "LIQUID CRYSTAL DISPLAY APPARATUS"), requiring a shorter writing time than in the four pulse method. In the pixel shift method, plural scanning lines are simultaneously supplied with different scanning signals for selection to provide an electric field intensity distribution spanning the plural scanning lines, thereby affecting a gradational display. According to this method, a variation in threshold due to a temperature variation can be absorbed by shifting a writing region over plural scanning lines.

An outline of the pixel shift method will now be described below.

Figure 12:
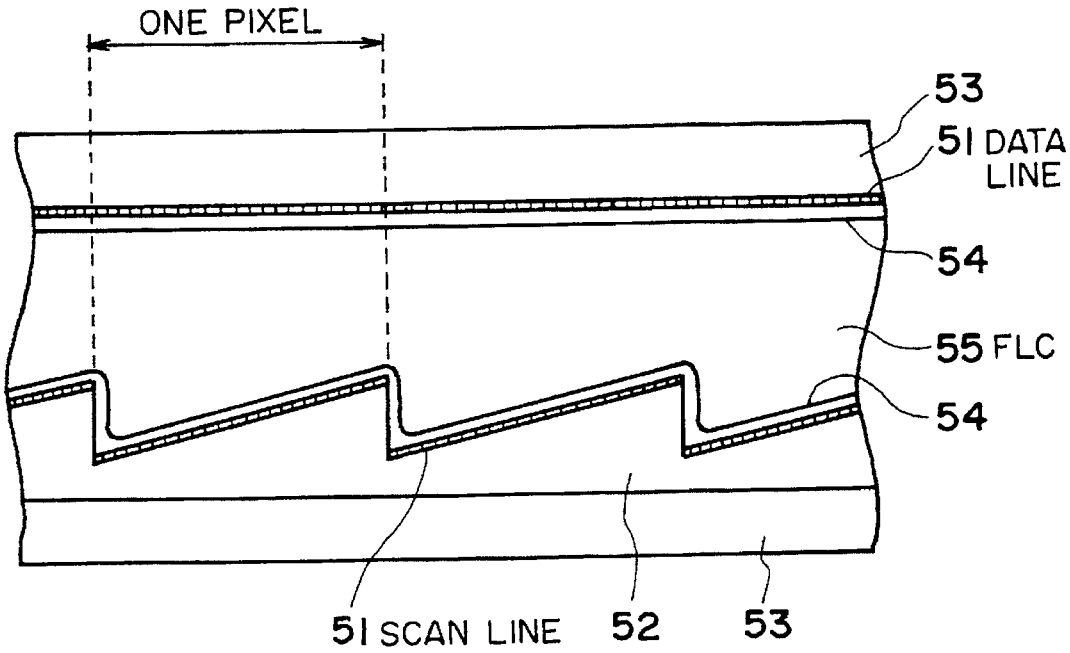
FIG. 12 is a schematic sectional view of a liquid crystal cell applicable to the invention.

A liquid crystal cell (panel) suitably used may be one having a threshold distribution within one pixel. Such a liquid crystal cell may for example have a sectional structure as shown in FIG. 12. The cell shown in FIG. 12 has an FLC layer 55 disposed between a pair of glass substrates 53 including one having thereon transparent stripe electrodes 53 constituting data lines and an alignment film 54 and the other having thereon a ripple-shaped film 52 of, e.g., an insulating resin, providing a saw-teeth shape cross section, transparent stripe electrodes 52 constituting scanning lines and an alignment film 54. In the liquid crystal cell, the FLC layer 55 between the electrodes has a gradient in thickness within one pixel so that the switching threshold of FLC is also caused to have a distribution. When such a pixel is supplied with an increasing voltage, the pixel is gradually switched from a smaller thickness portion to a larger thickness portion.

The switching behavior is illustrated with reference to FIG. 13A. Referring to FIG. 13, a panel in consideration is assumed to have portions having temperatures $T_1$, $T_2$ and $T_3$. The switching threshold voltage of FLC is lowered at a higher temperature. FIG. 13A shows three curves each representing a relationship between applied voltage and resultant transmittance at temperature $T_1$, $T_2$ or $T_3$.

Incidentally, the threshold change can be caused by a factor other than a temperature change, such as a layer thickness fluctuation, but an embodiment of the present invention will be described while referring to a threshold change caused by a temperature change, for convenience of explanation.

As is understood from FIG. 13A, when a pixel at a temperature $T_1$ is supplied with a voltage Vi, a transmittance of X % results at the pixel. If, however, the temperature of the pixel is increased to $T_2$ or $T_3$, a pixel supplied with the same voltage Vi is caused to show a transmittance of 100%, thus failing to perform a normal gradational display. FIG. 13C shows inversion states of pixels after writing. Under such conditions, written gradation data is lost due to a temperature change, so that the panel is applicable to only a limited use of display device.

In contrast thereto, it becomes possible to effect a gradational display stable against a temperature change by display data for one pixel on two scanning lines S1 and S2 as shown in FIG. 13D.

The drive scheme will be described in further detail hereinbelow.

(1) A ferroelectric liquid crystal cell as shown in FIG. 12 having a continuous threshold distribution within each pixel is provided. It is also possible to use a cell structure providing a potential gradient within each pixel as proposed by our research group in U.S. Pat. No. 4,815,823 or a cell structure having a capacitance gradient. In any way, by providing a continuous threshold distribution within each cell, it is possible to form a domain corresponding to a bright state and a domain corresponding to a dark state in mixture within one pixel, so that a gradational display becomes possible by controlling the areal ratio between the domains.

The method is applicable to a stepwise transmittance modulation (e.g., at 16 levels) but a continuous transmittance modulation is required for an analog gradational display.

(2) Two scanning lines are selected simultaneously. The operation is described with reference to FIG. 14. FIG. 14A shows an overall transmittance—applied voltage characteristic for combined pixels on two scanning lines. In FIG. 14A, a transmittance of 0–100% is allotted to be displayed by a pixel B on a scanning line 2 and a. transmittance of 100–200% is allotted to b displayed by a pixel A on a scanning line 1. More specifically, as one pixel is constituted by one scanning line, a transmittance of 200% is displayed when both the pixels A and B are wholly in a transparent state by scanning two scanning lines simultaneously. Herein, two scanning lines are selected for displaying one gradation data but a region having an area of one pixel is allotted to displaying one gradation data. This is explained with reference to FIG. 14B.

At temperature $T_1$, inputted gradation data is written in a region corresponding to 0% at an applied voltage $V_0$ and in a region corresponding to 100% at $V_{100}$. As shown in FIG. 14B, at temperature $T_1$, the range (pixel region) is wholly on the scanning line 2 (as denoted by a hatched region in FIG. 14B). When the temperature is raised from $T_1$ to $T_2$, however, the threshold voltage of the liquid crystal is lowered correspondingly, the same amplitude of voltage causes an inversion in a larger region in the pixel than at temperature $T_1$.

For correcting the deviation, a pixel region at temperature $T_2$ is set to span on scanning lines 1 and 2 (a hatched portion at $T_2$ in FIG. 14B).

Then, when the temperature is further raised to temperature $T_3$, a pixel region corresponding to an applied voltage in the range of $V_0$–$V_{100}$ is set to be on only the scanning line 1 (a hatched portion at $T_3$ in FIG. 14B).

By shifting the pixel region for a gradational display on two scanning lines depending on the temperature, it becomes possible to retain a normal gradation display in the temperature region of $T_1$–$T_3$.

(3) Different scanning signals are applied to the two scanning lines selected simultaneously. As described at (2) above, in order to compensate for the change in threshold of liquid crystal inversion due to a temperature range by selecting two scanning lines simultaneously, it is necessary to apply different scanning signals to the two selected scanning lines. This point is explained with reference to FIG. 13.

Scanning signals applied to scanning lines 1 and 2 are set so that the threshold of a pixel B on the scanning line 2 and the threshold of a pixel A on the scanning line 1 varies continuously. Referring to FIG. 13B, a transmittance-voltage curve at temperature 1 indicates that a transmittance up to 100% is displayed in a region on the scanning line 2 and a transmittance thereabove and up to 200% is displayed in a region on the scanning line 1. It is necessary to set the transmittance curve so that it is continuous and has an equal slope spanning from the pixel B to the pixel A.

As a result, even if the pixel A on the scanning line 1 and the pixel B on the scanning line 2 are set to have identical cell shapes, it becomes possible to effect a display substantially similar to that in the case where the pixel A and the pixel B are provided with a continuous threshold characteristic (cell at the right side of FIG. 13B).

In an FLC panel as described above, it is impossible to ignore a transmission delay of an input waveform due to a large capacitance between electrodes and a wire (or electrode) resistance in compliance with a higher resolution display.

Particularly, in the case of using display signals of positive and negative polarities selectively, the combined voltage waveform applied to the liquid crystal layer is given as a difference from the scanning signal, the voltage actually applied to the liquid crystal layer is liable to be above or below the objective value (depending on whether the data signal has a polarity identical to or opposite to the scanning signal), so that it is difficult to retain a uniform threshold distribution within a pixel.

This is particularly undesirable in a gradational control method such as the pixel shift method as described above. For this reason, the above-mentioned modulation system may preferably be applied.

EXAMPLE 1

As a first embodiment, a liquid crystal cell having a sectional structure as shown in FIG. 12 was prepared. The lower glass substrate 53 was provided with a saw-teeth shape cross section by transferring an original pattern formed on a mold onto a UV-curable resin layer applied thereon to form a cured acrylic resin layer 52.

The thus-formed UV-cured uneven resin layer 52 was then provided with stripe electrodes 51 of ITO film by sputtering and then coated with an about 300 Å-thick alignment film (formed with "LQ-1802", available from Hitachi Kasei K.K.).

The opposite glass substrate 53 was provided with stripe electrodes 51 of ITO film on a flat inner surface and coated with an identical alignment film.

Both substrates (more accurately, the alignment films thereon) were rubbed respectively in one direction and superposed with each other so that their rubbing directions were roughly parallel but the rubbing direction of the lower substrate formed a clockwise angle of about 6 degrees with respect to the rubbing direction of the upper substrate. The cell thickness (spacing) was controlled to be from about 1.0 μm as the smallest thickness to about 1.4 μm as the largest thickness. Further, the lower stripe electrodes 51 were formed along the ridge or ripple (extending in the thickness direction of the drawing) so as to provide one pixel width having one saw tooth span.

Then, the cell was filled with a chiral smectic liquid crystal A showing the following phase transition series and properties.

TABLE 1

(liquid crystal A)

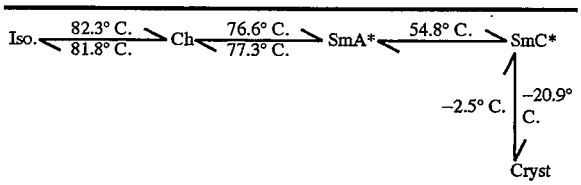

Ps = −5.8 nC/cm² (30° C.)
Tilt angle = 14.3 deg. (30° C.)
Δε ≒ −0 (30° C.)

The liquid crystal generally showed a threshold characteristic of 1.5 volts/μm (80 μsec pulse, 25° C.), and each pixel showed a threshold ranging from 11.5 volts–16.1 volts (80 μsec pulse, 25° C.).

In this way, a liquid crystal cell (panel) having a matrix electrode structure including 240 scanning lines and 400 data lines was prepared. Each scanning line was provided with a 2000 Å-thick Cr film along a side thereof. On the other hand, each data line showed rounding of a data signal waveform giving a delay time from rising of a data signal pulse np to a peak value of 90% of the set value of 20 μsec at the maximum.

Figure 16:
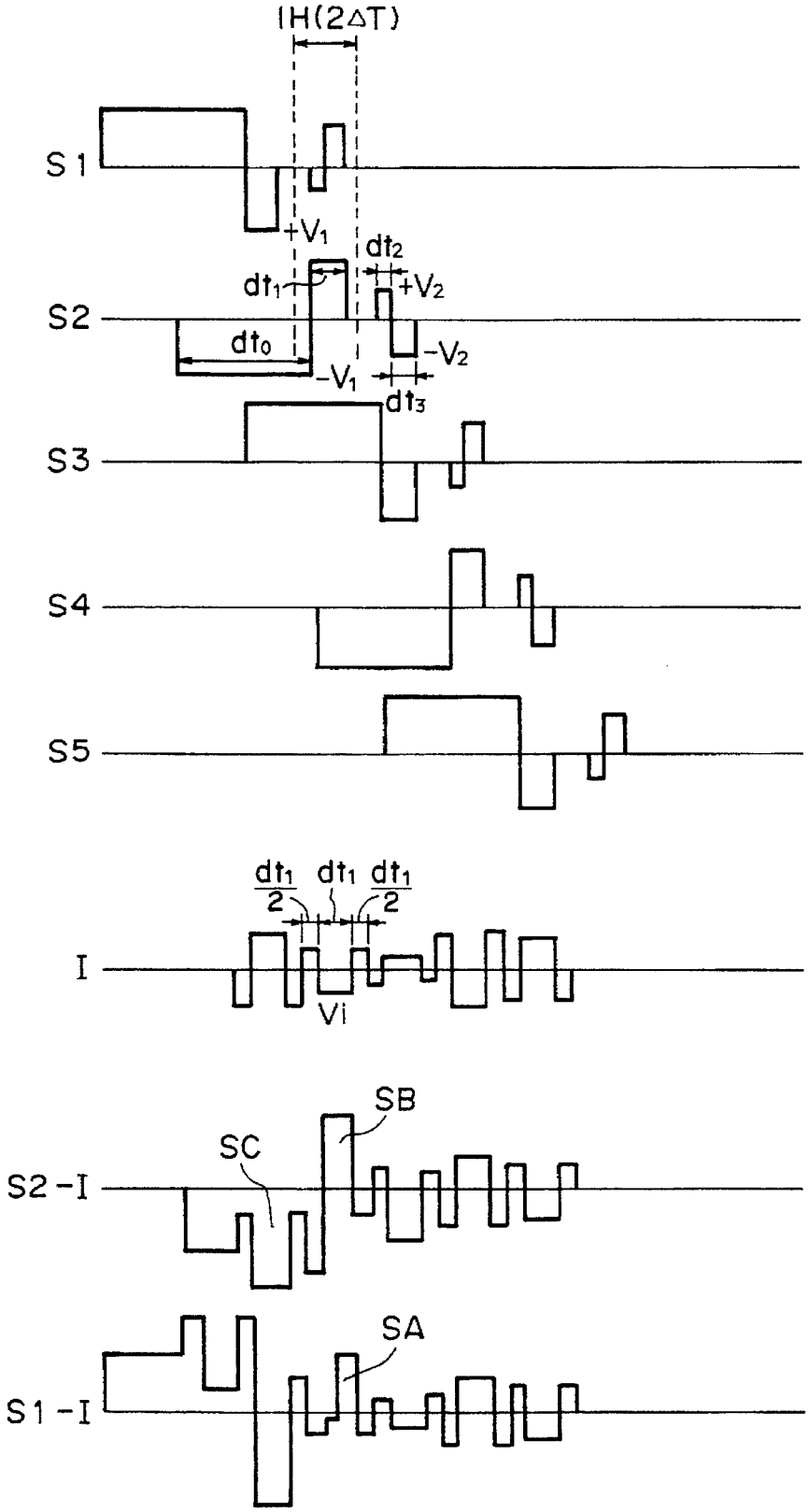
FIG. 16 is a waveform diagram showing a set of drive waveforms for driving a liquid crystal apparatus by the pixel shift method based on the present invention.

FIG. 16 is a waveform diagram showing a set of driven signal waveforms used in this embodiment including scanning signals applied to scanning lines $S_1, \ldots, S_5, \ldots$, data signals applied to a data line I, and combined voltage signals applied to pixels at $S_2$–I and $S_1$–I.

In this embodiment, a gradation drive scheme according to the pixel shift method was adopted, so that adjacent two scanning lines were supplied with scanning signals having mutually reverse polarities at corresponding phases.

Referring to FIG. 16, the respective pulses were characterized by parameters at $dt_1$=50 μsec, $dt_2$=20 μsec, $dt_3$=30 μsec, $dt_0$=200 μsec, $|V_1|$=13.8 volts, $|V_2|$=13.8 volts. Vi included in a data signal applied to a data line I was a data signal voltage including gradation data and the value thereof was modulated according to a scheme as described hereinafter.

The voltage signal Vi, if completely free from rounding, provides 0% at −2.75 volts, 100% at 2.75 volts, and an intermediate value at an intermediate voltage. In case where rounding is involved, however, the gradation levels are shifted in reverse directions with Vi=0 volt (free from rounding) as the boundary.

When rounding resulting in a delay time τ μs is involved, the correction scheme may be given as follows. Regarding a data signal Vi(t), the input value is represented by $V_0$ and the pulse width is represented by $t_0$. Thus, $Vi(t)=Vi(1-e^{-t/a\tau})$, $$\int_0^{t_0} Vi(t)dt = Vi\int_0^{t_0}(1-e^{-t/a\tau})dt = Vi\{t_0 + a\tau(e^{-t/a\tau}-1)\},$$

If this is set to be equal to $bV_0t_0$, $$bV_0t_0=Vi\{t_0+A\tau(e^{-t/a\tau}-1)\} \quad (1).$$

Herein, a and b are experimentally determined constants. More specifically, a represents a correction term for accurately catching the effect of rounding, and b represents a correction term for compensating for a deviation of the FLC switching value from the effective value. In this embodiment, a=1.09 and b=1.5. Accordingly, when writing is performed at a pixel showing a delay time τ of 20 μsec, a data signal Vi may be set as determined by the equation (1). Actually, the relationship between $V_0$ and Vi can depend on a gradation level (varying depending on liquid crystal, alignment, etc.) in some cases. In such a case, the relationship between $V_0$ and Vi may be stored within a memory device, such as ROM2 in FIG. 6 for reference in determining the data signal.

The relationship between $V_0$ and Vi in this embodiment is shown at transmittances of 0%, 50% and 100% in the following Table 2.

TABLE 2

| Transmittance (%) | Voltage applied to L.C. layer (volts) | Data signal voltage (volts) $V_0$ | Data signal voltage (volts) Vi* |
|---|---|---|---|
| 0 | 11 | −2.75 | −4.1 |
| 50 | 13.5 | −0.3 | −0.44 |
| 100 | 16.5 | +2.75 | +4.1 |

*In the case rounding providing a delay time τ of 20 μsec.

In the case of writing based on the waveforms shown in FIG. 16, the second writing by using a pulse SA was not affected by rounding of the data signal, so that a good gradational display was realized.

In this embodiment, the delay time data τ due to rounding at the respective scanning lines was stored within a memory device ROM1 in FIG. 6 and correction values depending on gradation levels were stored in a memory device ROM2. Further, an arithmetic program was stored within the ALC for executing the arithmetic formula (1).

Accordingly, the peak value Vi of the data signal was increased so as to compensate for the degree of rounding (τ) which increased as the scanning line position left away from the input terminals for data signals in the panel.

The degree of compensation for the degree of rounding a delay time (τ) was corrected depending on gradation data.

As described above, according to the present invention, good gradation display could be realized without being affected by a transmission delay of waveform on a data signal line.

What is claimed is:

1. A display apparatus, comprising:

a display panel comprising a first electrode plate having thereon a plurality of first elongated electrodes, a second electrode plate having thereon a plurality of second elongated electrodes, and a smectic liquid crystal disposed between said first and second electrode plates so as to form a pixel at each intersection of said first and second elongated electrodes;

drive means including:

application means for applying scanning signals to said first elongated electrodes and for applying data signals to said second elongated electrodes so as to provide a voltage signal to said smectic liquid crystal at said pixels, with each end of said second elongated electrodes being connected to said application means; and modulation means for modulating said data signals applied to said second elongated electrodes depending on a distance from the ends of said second elongated electrodes to associated pixels on said second elongated electrodes so as to compensate for a rounding of a voltage signal applied to said smectic liquid crystal at the associated pixels, wherein said modulation means causes a data signal for an i-th pixel having a delay time $\tau$ to have a voltage Vi so as to satisfy the formula:

$$bV_0t_0=Vi\{t_0+A\tau(e^{-t/a\tau}-1)\},$$

wherein a and b are constants, and $V_0$ and $t_0$ denote a voltage and a pulse width, respectively, of a voltage signal objectively applied to the i-th pixel having the delay time $\tau$ based on a distance of the i-th pixel from an input end of an associated second elongated electrode.

2. An apparatus according to claim 1, wherein the data signal is modulated with respect to its peak height.

3. An apparatus according to claim 1, wherein the data signal is modulated with respect to its pulse width.

4. An apparatus according to claim 1, wherein said data signal includes a gradation data signal.

5. An apparatus according to claim 1, wherein said first and second elongated electrodes respectively comprise a transparent conductor film.

6. An apparatus according to claim 1, further including a graphic controller and a voltage supply, wherein said drive means includes a scanning line drive circuit and a data line drive circuit.

7. An apparatus according to claim 6, wherein said data line drive circuit includes a memory for memorizing a modulated parameter corresponding to the scanning lines.

8. A display apparatus, comprising:

a display panel comprising a first electrode plate having thereon a plurality of first elongated electrodes, a second electrode plate having thereon a plurality of second elongated electrodes, and a smectic liquid crystal disposed between said first and second electrode plates so as to form a pixel at each intersection of said first and second elongated electrodes;

a driver for applying scanning signals to said first elongated electrodes and for applying data signals to said second elongated electrodes so as to provide a voltage signal to said smectic liquid crystal at said pixels, with each end of said second electrodes being connected to said application means; and a modulator for modulating said data signals to said second elongated electrodes depending on a distance from the ends of said second elongated electrodes to a group of associated pixels on said second elongated electrode so as to compensate for a rounding of a voltage applied to said smectic liquid crystal at the associated pixels, wherein said modulation means causes a data signal for an i-th pixel having a delay time $\tau$ to have a voltage Vi so as to satisfy the following formula:

$$bV_0t_0=Vi\{t_0+A\tau(e^{-t_0/a\tau}-1)\},$$

wherein a and b are constants, and $V_0$ and $t_0$ denote a voltage and a pulse width, respectively, of a voltage signal objectively applied to the i-th pixel having the delay time $\tau$ based on a distance of the i-th pixel from an input end of an associated second elongated electrode, said second elongated electrodes being divided into plural groups each including plural mutually adjacent second elongated electrodes, and the modulation being effected for each group.

9. A display apparatus, comprising:

a display panel comprising a first electrode plate having thereon a plurality of first elongated electrodes, a second electrode plate having thereon a plurality of second elongated electrodes, and a smectic liquid crystal disposed between said first and second electrode plates so as to form a pixel at each intersection of said first and second elongated electrodes; and drive means including:

application means for applying scanning signals to said first elongated electrodes and for applying data signals to said second elongated electrodes so as to provide a voltage signal to said smectic liquid crystal at said pixels, with each end of said second elongated electrodes being connected to said application means; and modulation means for modulating said data signals to said second elongated electrodes depending on a distance from the ends of said second elongated electrodes to associated pixels on said second elongated electrodes so as to compensate for a rounding of a voltage applied to said smectic liquid crystal at the associated pixels, wherein said modulation means causes a data signal for an i-th pixel having a delay time $\tau$ to have a voltage Vi so as to satisfy the following formula:

$$bV_0t_0=Vi\{t_0+A\tau(e^{-t_0/a\tau}-1)\},$$

wherein a and b are constants, and $V_0$ and $t_0$ denote a voltage and a pulse width, respectively, of a voltage signal objectively applied to the i-th pixel having the delay time $\tau$ determined based on a distance of the i-th pixel from an input end of an associated second elongated electrode, said modulator including a first memory for memorizing values of said $\tau$, and a second memory for memorizing correction parameters depending on gradation levels, said data signal being further corrected based on said correction parameters.

* * * * *

UNITED STATES PATENT AND TRADEMARK OFFICE

CERTIFICATE OF CORRECTION

PATENT NO. : 5,657,037

DATED : August 12, 1997

INVENTOR(S) : Okada et al.

It is certified that error appears in the above-identified patent and that said Letters Patent is hereby corrected as shown below:

ON THE TITLE PAGE:

Item
[30] FOREIGN APPLICATION PRIORITY DATA:

Insert --November 10, 1993 [JP] Japan ..... 5-303245--.

SHEET 9:

FIG. 13A, "VCLTAGAE" should read --VOLTAGE--.

COLUMN 4:

Line 65, "ill" should read --111--.

Signed and Sealed this

Ninth Day of June, 1998

*Attest:*

*Attesting Officer*

Bruce Lehman

BRUCE LEHMAN

*Commissioner of Patents and Trademarks*